US006761479B2

(12) United States Patent
Meyrat et al.

(10) Patent No.: US 6,761,479 B2
(45) Date of Patent: Jul. 13, 2004

(54) DEVICE FOR ADJUSTING THE ALIGNMENT OF A BACK COVER SCREWED ONTO THE MIDDLE PART OF A WATCHCASE WITH RESPECT TO A 12 O'CLOCK—6 O'CLOCK AXIS

(75) Inventors: Clément Meyrat, Le Landeron (CH); Jacques Müller, Reconvilier (CH)

(73) Assignee: The Swatch Group Management Services AG, Biel (CH)

( * ) Notice: Subject to any disclaimer, the term of this patent is extended or adjusted under 35 U.S.C. 154(b) by 166 days.

(21) Appl. No.: 10/196,278

(22) Filed: Jul. 17, 2002

(65) Prior Publication Data

US 2003/0016591 A1 Jan. 23, 2003

(30) Foreign Application Priority Data

Jul. 18, 2001 (CH) ..... 1323/01

(51) Int. Cl.[7] ..... A44C 5/00; G04B 37/00

(52) U.S. Cl. ..... 368/281; 368/297; 368/309; 368/310

(58) Field of Search ..... 368/88, 281, 297–300, 368/309–310

(56) References Cited

U.S. PATENT DOCUMENTS 1,488,458 A * 3/1924 Ecaubert ..... 220/298
4,298,973 A * 11/1981 Saito ..... 368/276
4,626,107 A * 12/1986 Nishikawa et al. ..... 368/276

FOREIGN PATENT DOCUMENTS

| | | |
|---|---|---|
| CH | 10950/60 | 12/1962 |
| DE | 2223007 | 12/1972 |

* cited by examiner

*Primary Examiner*—Vit W. Miska
(74) *Attorney, Agent, or Firm*—Griffin & Szipl, P.C.

(57) ABSTRACT

The present invention concerns a device for securing a back cover (6) to a middle part (28) of a watchcase (26), the back cover (6) having a screw thread (8) on its outer periphery, the device being characterized in that it includes an intermediate element (1) including a resilient blocking element (4) and a metal element (2) concentric to the resilient blocking element (4), this intermediate assembly being forcibly driven into the lower part of the middle part (28) of the watch (26), and the back cover (6) being screwed onto the metal element (2) so that, when the back cover (6) is completely screwed onto the metal element (2), the metal element (2) can be pivoted by sliding on the resilient blocking element (4) to a stop point from which the resilient blocking element (4) can in turn pivot by sliding on the middle part (28) of the watch (26), allowing the alignment of the back cover (6) to be adjusted with respect to the vertical 12 o'clock–6 o'clock axis of the watch (26).

21 Claims, 5 Drawing Sheets

DEVICE FOR ADJUSTING THE ALIGNMENT OF A BACK COVER SCREWED ONTO THE MIDDLE PART OF A WATCHCASE WITH RESPECT TO A 12 O'CLOCK— 6 O'CLOCK AXIS

FIELD OF THE INVENTION

The present invention concerns a system for adjusting the alignment of a back cover which screws onto the middle part of a watchcase with respect to a vertical 12 o'clock-6 o'clock axis.

BACKGROUND OF THE INVENTION

As the back cover of a watchcase is being screwed onto the middle part of the case, it frequently happens that, when the back cover is completely screwed on, one can see that the decorative markings or designs which may have been made for example by die stamping or engraving on the face of the back cover located on the side of the watch wearer's wrist, are not properly aligned with respect to the vertical 12 o'clock-6 o'clock axis of said watch, which, of course, is detrimental to the aesthetic appearance of said watch.

While this defective appearance may be tolerated for inexpensive watches, it constitutes a very inconvenient drawback for more expensive watches.

In order to overcome this drawback, the only solution known to date consists in coupling a back cover to a determined watchcase during machining, so as to ensure that, once completely screwed on, the back cover is perfectly aligned with the 12 o'clock-6 o'clock axis of the watch. This solution is however unsatisfactory since problems arise if the original back cover of the watch is ever lost or ruined and it becomes necessary to replace it with another back cover, which, one cannot be sure, will still be properly aligned with the vertical 12 o'clock-6 o'clock axis, once it is screwed onto the middle part.

The object of the present invention is to overcome this drawback in addition to others by proposing a system which, after screwing a back cover onto the middle part of a watchcase, enables the alignment of the back cover to be adjusted simply and efficiently with respect to the 12 o'clock-6 o'clock axis of the watch, so as to guarantee the proper disposition of the markings and other decorative designs which have been added to the face of the back cover of the watch oriented towards the side of the watch wearer's wrist.

SUMMARY OF THE INVENTION

The present invention thus concerns a device for securing a back cover to a middle part of a watchcase, the back cover having a screw thread on its outer periphery, the device being characterised in that it includes an intermediate element forcibly driven into the lower part of the middle part of the watch, the back cover being screwed via its screw thread onto the intermediate element which has, for this purpose, on its inner periphery, a complementary screw thread, this intermediate element being capable of being forced to pivot with respect to the middle part of the watch to adjust the alignment of said back cover with respect to the vertical 12 o'clock–6 o'clock axis of said watch.

As a result of these features, the present invention provides a device for securing a watchcase back cover which not only enables the back cover to be completely screwed onto the middle part of the watch so as to assure the sealing thereof and to avoid as far as possible any risk of losing said back cover, then, although the back cover is tightly screwed, enables the back cover to be pivoted with respect to the middle part in order to make up for any lack of alignment of the markings or designs made on the visible face of said back cover with respect to the 12 o'clock-6 o'clock axis of the watch.

The problems of the prior art are thus resolved. In particular, one is no longer obliged to machine the back covers and the middle parts in pairs with great precision in order to ensure that, during assembly, when a back cover is completely screwed onto the corresponding middle part, the back cover will be properly aligned with respect to the vertical axis of the watch. By reducing the requirements as to the precision with which the back covers and middle parts have to be machined, the present invention thus allows the manufacturing costs to be substantially reduced and limits the number of parts which have to be discarded because of machining defects, which, of course, has a favourable impact on the cost price of the finished watch.

According to another feature of the invention, the intermediate element includes a resilient blocking element and a metal element which is arranged concentrically inside of the resilient blocking element, the back cover being screwed onto the metal element so that, when the back cover is completely screwed onto said metal element, the metal element can be forced to pivot with respect to the middle part of the watch, by sliding on the resilient blocking element which remains fixed up to a stop point from which the metal element becomes fixed again with respect to the metal blocking element, which, in turn, can be forced to pivot by sliding on the middle part of the watch by being driven to pivot by said metal element, this allowing the alignment of the back cover to be adjusted with respect to the vertical 12 o'clock-6 o'clock axis of said watch.

According to another feature of the invention, the alignment adjustment torque of the back cover with respect to the vertical axis is less than the blocking torque of the back cover on the intermediate element via which said back cover is mounted on the middle part.

One can thus be sure that the back cover is not liable to become unscrewed when it is pivoted to adjust its vertical alignment.

BRIEF DESCRIPTION OF THE DRAWINGS

Other features and advantages of the present invention will appear more clearly from the following description of an example embodiment of the securing device according to the invention, this example being given purely by way of non-limiting illustration with reference to the annexed drawings, in which.

DETAILED DESCRIPTION OF THE PREFERRED EMBODIMENTS

The present invention proceeds from the general inventive idea which consists in screwing a back cover not directly onto the middle part of a watchcase, but onto an intermediate assembly forcibly driven into the lower part of the middle part of the watch, so that the back cover, tightly screwed onto the intermediate assembly, cannot be lost, while being capable of being pivoted with respect to the middle part of the watch in order to adjust its alignment with respect to the vertical 12 o'clock-6 o'clock axis of said watch. As a result of these features, the present invention provides a timepiece whose middle part and back cover do not need to be machined with great precision, which allows the manufacturing costs to be reduced.

Figure 1:
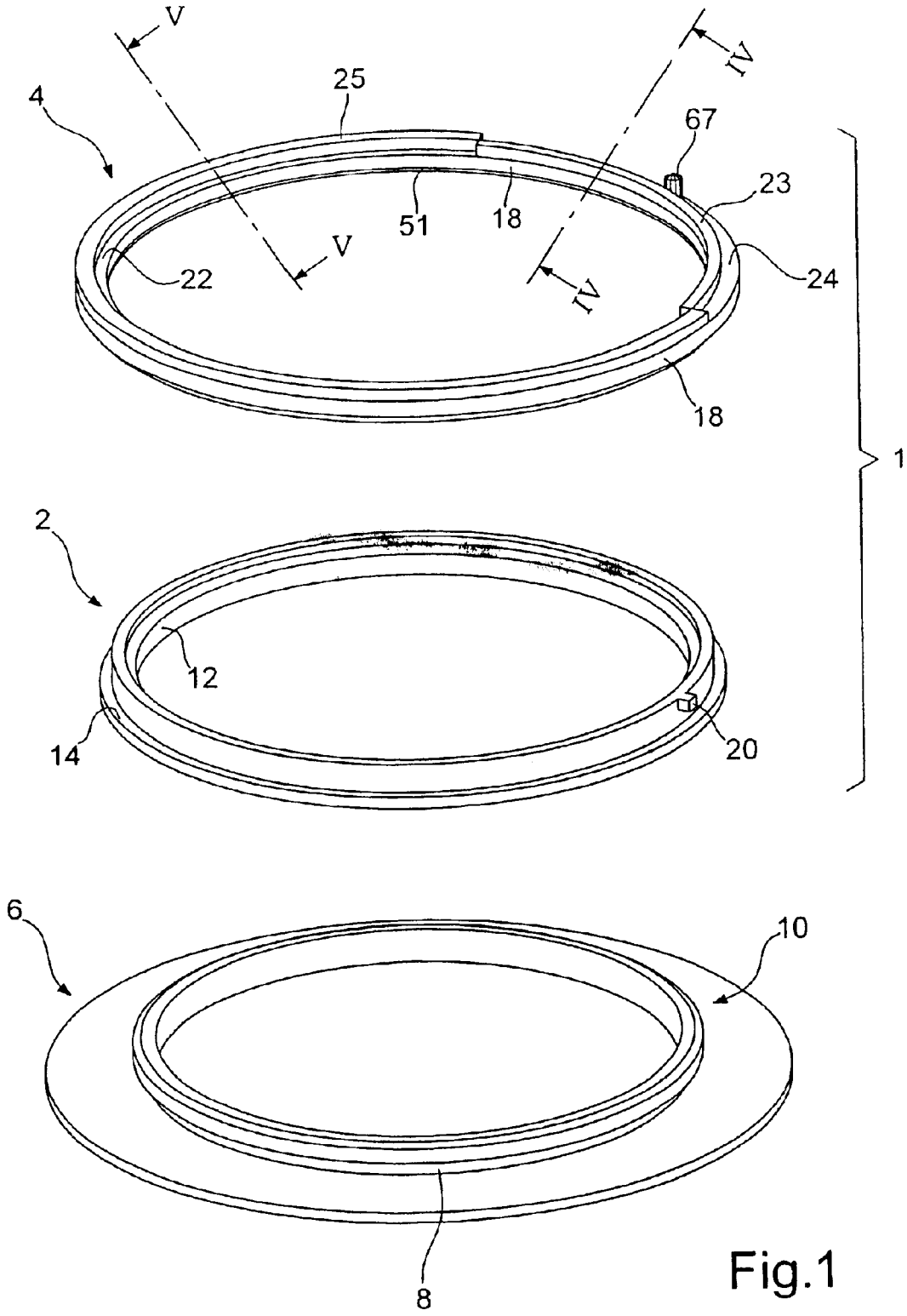
FIG. 1 is an exploded perspective view of the intermediate assembly via which a back cover is mounted on the middle part of the watch, this intermediate assembly including a resilient blocking element and a metal element concentric to the resilient blocking element and onto which the back cover is screwed.

The intermediate assembly according to the invention intended for securing a back cover onto the middle part of a watch is shown in perspective and in separate parts in FIG. 1. Designated as a whole by the general reference numeral 1, this intermediate assembly includes a metal element 2 which takes the general shape of a ring and which is arranged concentrically inside a resilient blocking element 4, which is also substantially shaped like a ring.

A circular back cover 6 is screwed, via a screw thread 8 of a crown 10, which stands concentric on the inner face of said back cover 6, on metal element 2 which has for that purpose on its inner periphery a complementary threading 12.

Figure 2:
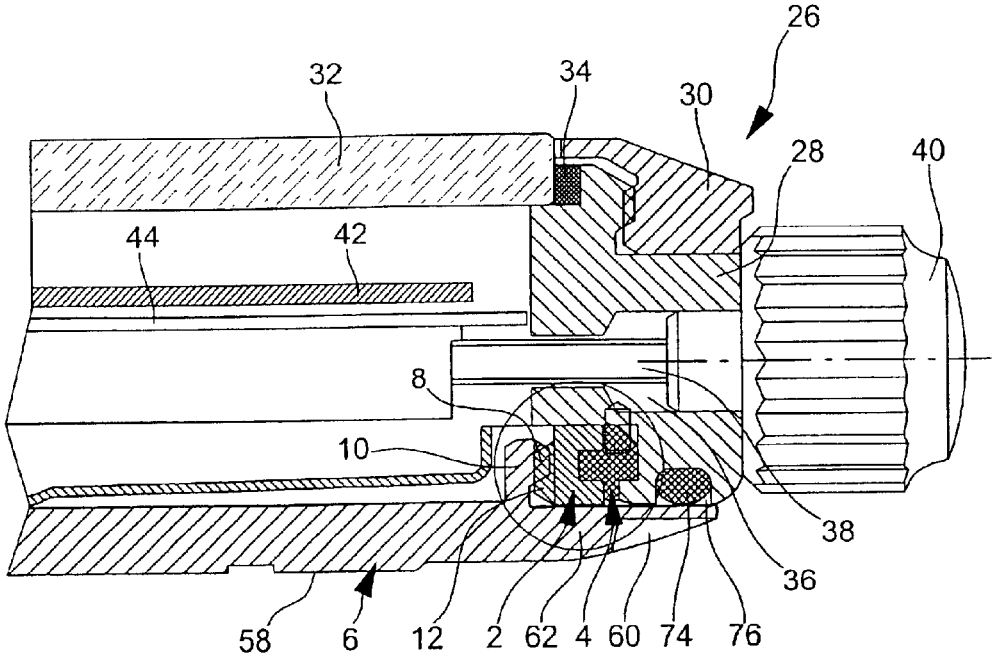
FIG. 2 is a cross-section made at the position of the snug of the metal element of a timepiece including an intermediate element for securing the back cover in accordance with the invention.
Figure 3:
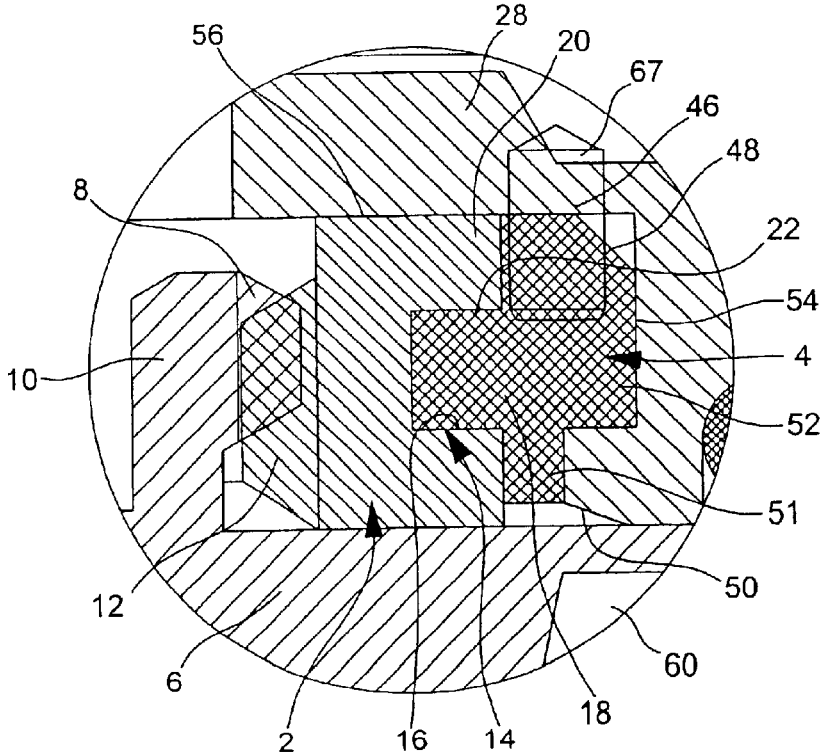
FIG. 3 is a larger scale view of the region surrounded by a circle in FIG. 2.
Figure 4:
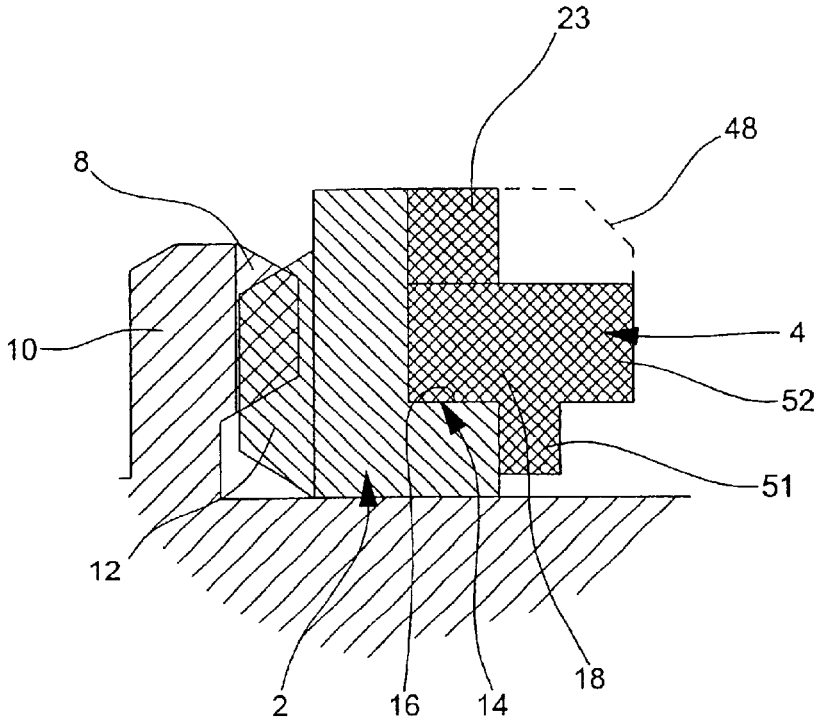
FIG. 4 is a cross-section of the resilient blocking element along the axis IV—IV of FIG. 1.
Figure 5:
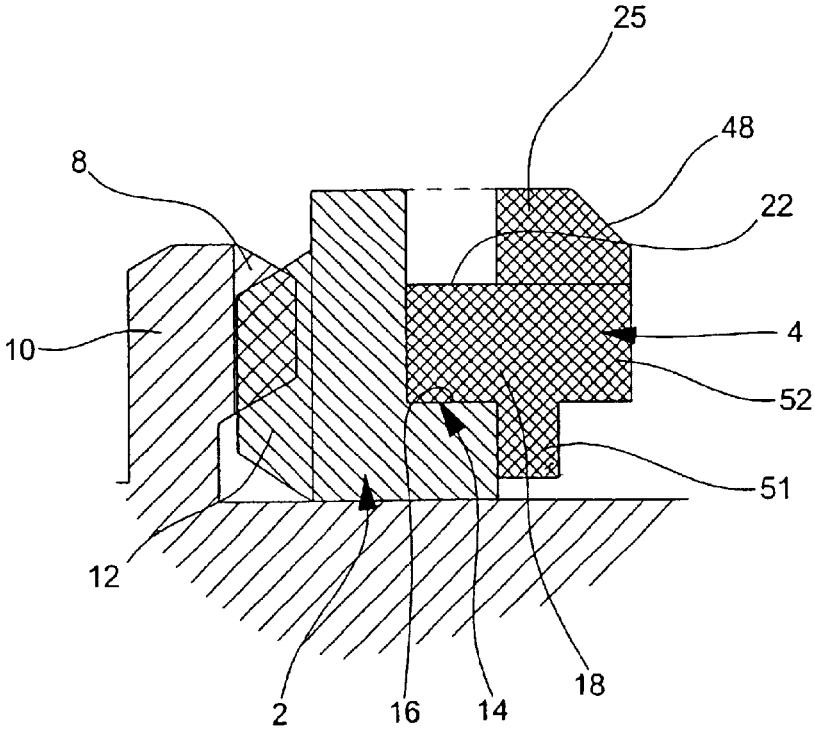
FIG. 5 is another cross-section along the axis V—V of FIG. 1 of the resilient blocking element.

As can be seen in FIG. 1 as well as in FIGS. 2 and 3 metal element 2 has on its periphery an outer annular shoulder 14 on the upper surface 16 of which abuts a collar 18, which extends along the inner periphery of resilient blocking element 4.

Metal element 2 also includes a snug 20 which, as will be described in more detail hereinafter, is able to pivot by an angle $\alpha$ (FIG. 7) along a rim 22 in the shape of an arc of a circle delimited by a border 23 arranged on the inner periphery of resilient blocking element 4. Resilient blocking element 4 also includes, arranged on its outer periphery, a second rim 24 delimited by a border 25. This outer rim 24 also forms, in the zone where inner rim 22 does not exist, an arc of a circle which is substantially complementary to that formed by said inner rim 22. In other words, the angle $\beta$ (FIG. 8), which intersects the arc of a circle formed by the second rim 24, has a value such that, when added to angle $\alpha$, it produces a sum of 360°. In the example shown in the Figures, angle $\alpha$ preferably has a value of 270°, which corresponds to three quarters of the perimeter of a circle, and angle $\beta$ thus has a value of 90° corresponding to the last quarter circle. It goes without saying however, that the angles $\alpha$ and $\beta$ can take any value provided that the sum thereof remains equal to 360°. This condition as to the value of the sum of angles $\alpha$ and $\beta$ is imposed by the fact that there may be cases where it is necessary to be able to pivot back cover 6 through one complete revolution if the back cover is totally out of alignment with respect to the vertical 12 o'clock-6 o'clock axis of the watch.

The timepiece, for example of the wristwatch type, which is provided with intermediate assembly 1 according to the invention via which the back cover is mounted onto the middle part of the watch is partially shown in FIGS. 2 and 3. Designated as a whole by the general reference numeral 26, this timepiece includes in particular a middle part 28 on which is mounted a bezel 30 which can be screwed onto middle part 28 and which is used to hold a crystal 32. The assembly formed by bezel 30 and crystal 32 is made watertight by the insertion of a sealing gasket 34. Middle part 28 also has an opening 36 for the passage of a stem 38 onto which a crown 40 is secured. In the example shown in FIGS. 2 and 3, wristwatch 26 is of the analogue time display type and thus includes a set of hands 42 for the hours and minutes (a single hand has been shown in the drawing) moving above a dial 44. It goes without saying that the present invention could equally apply to a digital time display watch including, for example, a liquid crystal cell.

As will have been understood from the foregoing, the present invention can be applied to any type of timepiece having a circular back cover and in order to be implemented, requires only minor modifications, which essentially concern the shape to be given to the lower part of middle part 28 where the junction occurs with intermediate assembly 1 for securing back cover 6 in accordance with the invention.

Resilient blocking element 4 forms an annular recess at its centre in which metal element 2 can be engaged. Assembly 1 then has to be mounted in watch 26.

Thus, intermediate assembly 1 formed by metal element 2 and resilient blocking element 4 is forcibly driven from the bottom of watch 26 into the middle part. In order to facilitate this engagement movement, resilient element 4 has, over the entire length of its upper edge 46 located on the outer side of watch 26, a sloping plane 48 which slides onto a corresponding sloping plane 50 arranged on the lower part of middle part 28.

Metal element 2 and resilient element 4 are sized such that when they are forcibly driven into middle part 28, metal element 2 presses resilient element 4 radially against said middle part 28, which has the effect of compressing said resilient element 4. This resilient element 4 includes in particular, a base 51 which extends along its lower part and which, in reaction to the compression force, will apply metal element rigidly against back cover 6, guaranteeing proper holding of the constructive assembly. A compression set of base 51 of the order of 20% is preferred. Such a rate causes an increase in the friction forces between metal element 2 and resilient element 4 on the one hand, and between the latter and middle part 28 on the other hand, and thus determines the torques involved in adjusting the alignment of back cover 6 with respect to the vertical 12 o'clock-6 o'clock axis of watch 26 as will now be described with reference to FIGS. 6 to 8.

In order to hold it axially, resilient element 4 includes over its entire outer periphery, a projecting part 52 that penetrates a groove 54 arranged opposite in middle part 28. Groove 54 has an upper return portion 56 which overhangs resilient element 4 and metal element 2 and acts as a stop surface for them.

Once intermediate assembly 1 according to the invention is engaged in middle part 28 of watch 26, back cover 6 can be screwed onto metal element 2. Thus, back cover 6 includes, on its outer surface 58 turned to the side of the wrist of the person wearing watch 26, notches 60 which are used for introducing the studs of a chuck key (not shown) which will allow said back cover 6 to be completely screwed into metal element 2.

It will be noted that back cover 6 moves forward under middle part 28 of watch 26 so as to mask metal element 2 and resilient element 4 from the observer's view. The edge portion 62 of back cover 6 also acts as a stop surface against metal element 2 at the end of screwing on said back cover 6.

Figure 6:
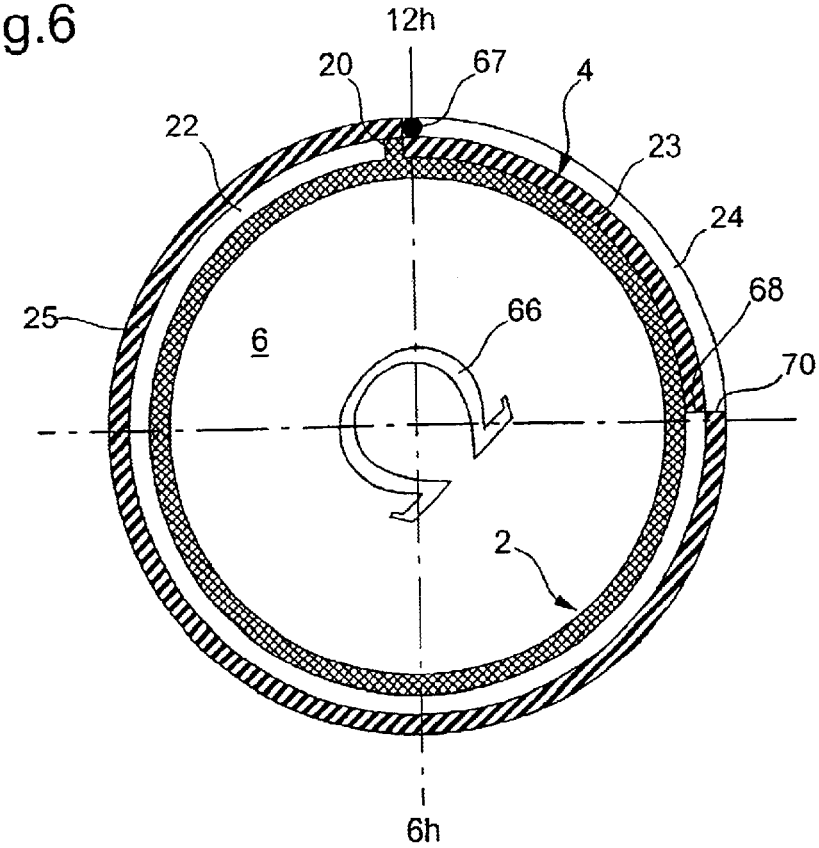
FIG. 6 is a plan view of the back cover of the watchcase tightly screwed onto the metal element of the intermediate assembly, the back cover not having been properly aligned with respect to the vertical 12 o'clock-6 o'clock axis of the watch.

In FIG. 6, it can be seen that a design 66 (in this case, it is the capital Greek letter omega) added to the visible outer surface 58 of back cover 6 by any appropriate technique such as die stamping or engraving, is totally out of alignment with respect to the vertical 12 o'clock-6 o'clock axis of watch 26. The problem thus consists in correcting this design 66 so that it is properly aligned and that the aesthetic appearance of watch 26 is thereby improved.

The present invention allows the aforementioned problem to be resolved. First of all, back cover 6 has been completely screwed into metal element 2 using a chuck key. Back cover 6 can in fact be screwed to a strong blocking torque because snug 20 of metal element 2 abuts against inner border 23 of resilient element 4 which itself abuts, by its outer border 25, against a pin 27 forcibly driven into middle part 28 of watch 26 (see FIG. 6).

Back cover 6 is screwed by being rotated in the clockwise direction. Since design 66 is out of alignment with respect to the 12 o'clock-6 o'clock axis, the assembly formed by back cover 6 and metal element 2, onto which said back cover 6 is screwed in the anticlockwise direction along arrow A (FIG. 7), will now be pivoted, again using the chuck key. Back cover 6 and metal element 2 which are fixed with respect to each other pivot relative to resilient blocking element 4.

Of course, the torque which has to be exerted to be able to pivot the back cover 6/metal element 2 assembly has to be less than the blocking torque of said back cover 6 on said metal element 2, otherwise back cover 6 would be liable to become unscrewed. The alignment adjustment torque of back cover 6 with respect to the vertical 12 o'clock-6 o'clock axis of watch 26 is essentially determined by the friction forces which are exerted between metal element 2 and resilient element 4 at base 51 of the latter. As was already described hereinbefore, a compression set of the order of 20% of base 51 is preferred since it has been observed that, via the friction forces which it induces between metal element 2 and resilient element 4, such a rate leads to a alignment adjustment rate of back cover 6 which is sufficiently high to prevent said back cover 6 from being liable to be inadvertently moved, but is sufficiently low that rotating back cover 6 in the anticlockwise direction will not unscrew it.

Figure 7:
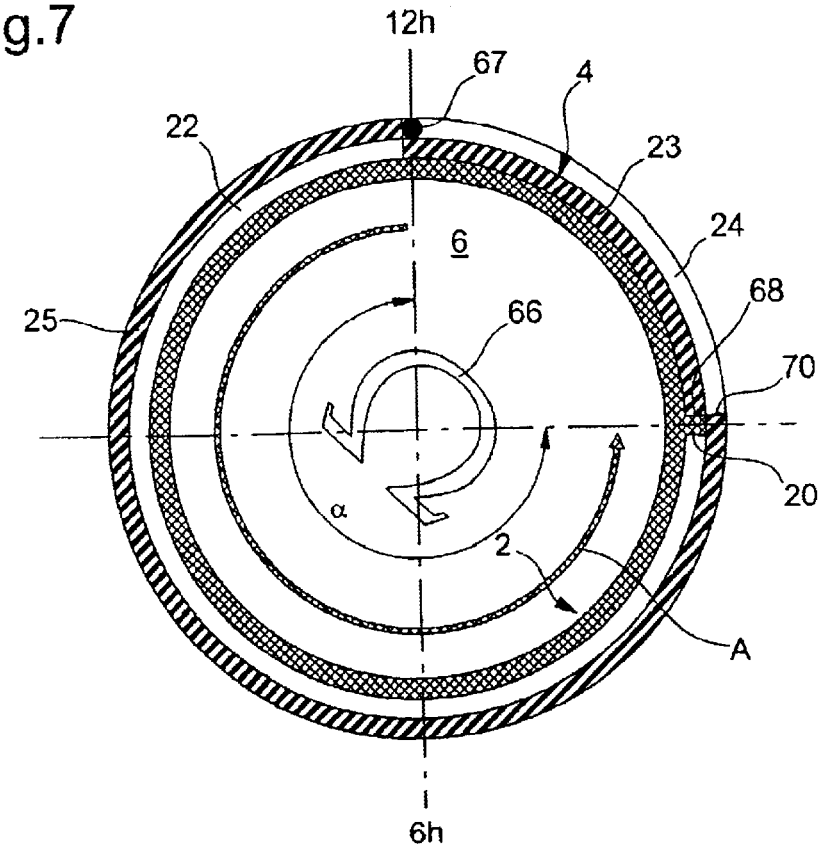
FIG. 7 is a similar view to that of FIG. 6 in which one can see that the assembly formed by the back cover screwed onto the metal element has been pivoted with respect to the resilient blocking element to a position in which a snug of the metal element is stopped against the resilient blocking element.

It can be seen in FIG. 7 that the back cover 6/metal element 2 assembly has pivoted by an angle $\alpha$ substantially equal to 270° relative to resilient blocking element 4 which remain fixed. During this movement, the snug 20 which projects onto the outer periphery of metal element 2 has slid along the upper surface of inner rim 22 of resilient element 4. The end of travel position of the assembly formed by back cover 6 and metal element 2 is determined by the point where snug 20 comes to a stop against a vertical face 68 of inner border 23 which delimits the inner rim 22 of resilient element 4 (FIG. 7).

Of course, if, during this movement, design 66 passes through a position in which it is aligned with the vertical 12 o'clock-6 o'clock axis of watch 26, one will stop rotating the back cover.

In the case shown in the drawing, it will be observed that, when it abuts against resilient blocking element 4, back cover 6 is still not properly aligned. One thus has to continue to pivot back cover 6 using the same chuck key as that used in the preceding step.

During this new pivoting movement, the resilient blocking element does not remain stationary. Indeed, it is driven to pivot by snug 20 of metal element 4, which abuts against the vertical face 68 of said resilient element 4. Of course, the torque which has to be exerted to drive the back cover 6/metal element 2/resilient element 4 assembly along arrow B (FIG. 8) in the anticlockwise direction has to be lower than the blocking torque of back cover 6 onto metal element 2 to avoid inadvertently unscrewing said back cover 6. This new alignment adjustment torque of back cover 6 with respect to the vertical 12 o'clock-6 o'clock axis of watch 26 is essentially determined by the friction forces that are exerted between resilient blocking element 4 and middle part 28 of watch 26 at base 51.

Figure 8:
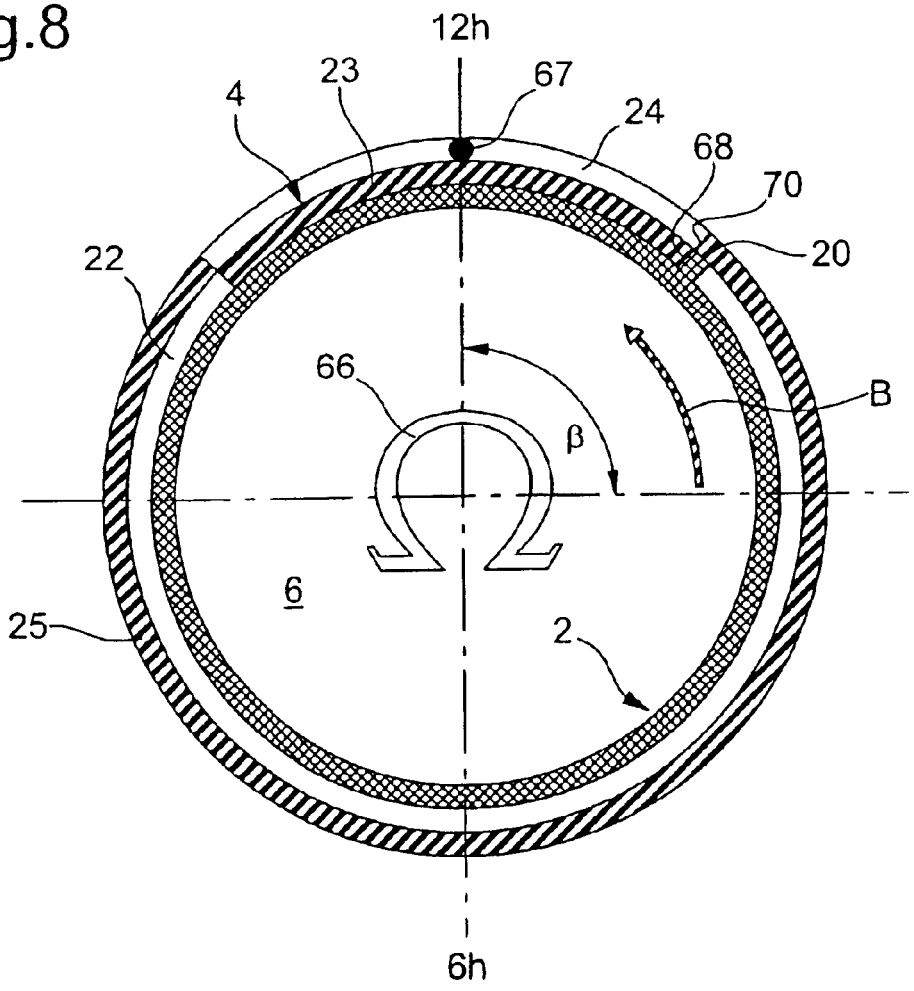
FIG. 8 is a similar view to that of FIG. 6 in which one can see that the screwed on back cover and the intermediate assembly via which said back cover is secured to the middle part have been pivoted with respect to the middle part into the position in which the design added to the visible face of the back cover is properly aligned with respect to the vertical axis.

As can be seen in FIG. 8, design 66 added to the visible face of back cover 6 is finally properly aligned with the vertical 12 o'clock-6 o'clock axis of watch 26. To obtain this result, the back cover 6/metal element 2/resilient element 4 assembly had to be pivoted again by a fraction of angle $\beta$.

The problem now arises as to how to unscrew back cover 6 when this is necessary. In order to do this, one continues to rotate back cover 6 and intermediate assembly 1 according to the invention via which back cover 6 is mounted on middle part 28 of the case of watch 26 until resilient element 4 abuts, via a vertical face 70 of its border 25 which delimits its outer rim 22, against pin 67 driven into middle part 28 of watch 26. Resilient element 4 is thus immobilised, as is metal element 2, which abuts, via its snug 20, against vertical face 68 of inner border 23 of said resilient element 4. As the two elements forming intermediate assembly 1 are now held perfectly stationary relative to the middle part, they oppose a sufficient force to the blocking torque of back cover 6 on metal element 2, which enables back cover 6 to be unscrewed by being pivoted in the anticlockwise direction. An endless screwing effect is thus avoided.

It will be noted that an 0 ring 74 is conventionally inserted in an annular groove 76 made at the base of middle part 28 to guarantee the sealing between back cover 6 and said middle part 28.

Metal element 2 can be made of brass. Resilient blocking element 4 may be made of a natural or synthetic elastomer, or even of a thermoplastic material whose remanence set after compression is well suited to the requirements of the present invention.

It goes without saying that the invention is not limited to the embodiment which has just been described and that various simple modifications and variants can be envisaged without departing from the scope of the invention.

In particular, resilient blocking element 4 and metal element 2 can be introduced into watch 26 from the side of the crystal, at an early stage of the manufacture of watch 26, when neither the watch movement, nor the hands or crystal have yet been mounted.

What is claimed is:

1. A device for securing a back cover to a middle part of a watchcase, the back cover having a screw thread on its outer periphery, wherein it includes an intermediate element forcibly driven in the lower part of the middle part of the watch, the back cover being screwed via its screw thread onto the intermediate element which has, for this purpose, on its inner periphery, a complementary screw thread, this intermediate element being capable of being forced to pivot with respect to the middle part of the watch to adjust the alignment of said back cover with respect to the vertical 12 o'clock–6 o'clock axis of said watch.

2. The securing device according to claim 1, wherein the intermediate element includes a resilient blocking element which is compressed transversely, and a metal element which is arranged concentrically inside of the resilient blocking element, the back cover being screwed onto the metal element so that, when the back cover is completely screwed onto said metal element, the metal element can be forced to pivot by an angle of less than 360° with respect to the middle part of the watch, by sliding on the resilient blocking element which remains fixed up to point a where the metal element abuts against said resilient element.

3. The securing device according to claim 2, wherein the resilient blocking element can be forcibly pivoted by an angle of less than 360° by sliding on the middle part of the watch and being driven to pivot by said metal element.

4. The securing device according to claim 2, wherein the alignment adjustment torque of the back cover with respect to the vertical 12 o'clock–6 o'clock axis of the watch, which is determined by the compression set of the resilient blocking element is less than the screwing torque of said back cover on the metal element.

5. The securing device according to claim 3, wherein the alignment adjustment torque of the back cover with respect to the vertical 12 o'clock–6 o'clock axis of the watch, which is determined by the compression set of the resilient blocking element is less than the screwing torque of said back cover on the metal element.

6. The securing device according to claim 2, wherein the metal element is able to pivot by an angle ($\alpha$) with respect to the resilient blocking element and in that said metal element and said resilient blocking element are able to pivot together by an angle ($\beta$) whose value is such that, when added to that of the angle ($\beta$) it produces a sum of 360°.

7. The securing device according to claim 6, wherein the angle ($\alpha$) is equal to 270° and the angle ($\beta$) is equal to 90°.

8. The securing device according to claim 6, wherein the resilient blocking element has a first rim in the shape of an arc of a circle arranged on its inner periphery and a second rim, also in the shape of an arc of a circle, arranged on its outer periphery which is complementary to that formed by the inner rim.

9. The securing device according to claim 8, wherein the metal element includes a snug which projects from its outer periphery and which is able to pivot by the angle ($\alpha$) along the inner rim of the resilient blocking element.

10. The securing device according to claim 9, wherein, after the back cover has been completely screwed in the clockwise direction onto the metal element, the assembly formed by the back cover and the metal element is pivoted in the anticlockwise direction by at least a fraction of the angle ($\alpha$) by sliding on the resilient blocking element which remains fixed, and in that, if the back cover is still not properly aligned with respect to the vertical 12 o'clock–6 o'clock axis of the watch when said assembly has pivoted by the angle ($\alpha$), it drives the resilient blocking element (4) to pivot, which slides on the middle part by at least a fraction of the angle ($\beta$).

11. The securing device according to claim 10, wherein the metal element drives the resilient blocking element to pivot via its snug which abuts against said resilient element.

12. The securing device according to claim 4, wherein, in order to unscrew back cover, the assembly formed by said back cover, the metal element and the resilient blocking element, is pivoted in the anticlockwise direction until the resilient element is immobilised against a pin driven into the middle part of the watch, the metal element being immobilised in turn by abutting via its snug against said resilient element, so that the back cover can then be unscrewed.

13. The securing device according to claim 2, wherein the resilient blocking element includes a base which extends along its lower part and which is compressed between the metal element and the middle part of the watch when the back cover is screwed onto said metal element.

14. The securing device according to claim 2, wherein, in order to hold it axially, the resilient element includes a projecting portion which penetrates an opposite groove arranged in the middle part.

15. The securing device according to claim 14, wherein the groove has a return portion which overhangs the resilient element and the metal element so as to prevent the latter from moving axially upwards.

16. The securing device according to claim 2, wherein the metal element has on its outer periphery an annular shoulder on the upper surface of which a collar, which extends along the inner periphery of the resilient element abuts.

17. The securing device according to claim 2, wherein, in order to facilitate the forcible introduction of the intermediate assembly from the bottom of the middle part of the watch, the resilient element has over the entire length of its upper edge located on the outer side of the watch, a sloping plane which slides on a corresponding sloping plane arranged in the lower part of the middle part.

18. The securing device according to claim 2, wherein the back cover moves forward under the middle part of the watch so as to act as a support surface for the metal element in order to prevent the latter from moving axially downwards.

19. The securing device according to claim 1, wherein the back cover includes, on its outer surface turned to the side of the wrist of the person wearing the watch, notches which are used for introducing the studs of a chuck key.

20. The securing device according to claim 1, wherein an O ring is inserted into an annular groove made at the base of the middle part to guarantee sealing between the back cover and said middle part.

21. The securing device according to claim 7, wherein the resilient blocking element has a first rim in the shape of an arc of a circle arranged on its inner periphery and a second rim, also in the shape of an arc of a circle, arranged on its outer periphery which is complementary to that formed by the inner rim.

* * * * *